US005270610A

United States Patent [19]

Schoenherr et al.

[11] Patent Number: 5,270,610

[45] Date of Patent: Dec. 14, 1993

[54] VIBRATION RESISTANT LAMP AND BASE, AND METHOD OF ITS MANUFACTURE

[75] Inventors: Walter Schoenherr, Giengen; Fritz Eckhardt, Gerstetten, both of Fed. Rep. of Germany

[73] Assignee: Patent-Treuhand-Gesellschaft für elektrische Glühlampen mbH, Munich, Fed. Rep. of Germany

[21] Appl. No.: 694,465

[22] Filed: May 1, 1991

[30] Foreign Application Priority Data

May 8, 1990 [DE] Fed. Rep. of Germany ..... 4014745

[51] Int. Cl.[5] ..... H01J 5/48

[52] U.S. Cl. ..... 313/318; 313/113; 439/602; 439/616; 445/26; 445/28; 445/44

[58] Field of Search ..... 313/318, 113; 439/602, 439/616; 445/26, 28, 44; 156/272.4

[56] References Cited

U.S. PATENT DOCUMENTS 4,795,939 1/1989 Eckhardt et al. .
4,982,131 1/1991 Meyer et al. ..... 313/113

FOREIGN PATENT DOCUMENTS 0212414 3/1987 European Pat. Off. .
0231936 8/1987 European Pat. Off. .
0261722 3/1988 European Pat. Off. .
452751 11/1927 Fed. Rep. of Germany .
2634980 2/1978 Fed. Rep. of Germany .
1216843 3/1960 France .
2498810 7/1982 France .
245080 4/1987 German Democratic Rep. .

*Primary Examiner*—Donald J. Yusko
*Assistant Examiner*—N. D. Patel
*Attorney, Agent, or Firm*—Frishauf, Holtz, Goodman & Woodward

[57] ABSTRACT

To connect a vitreous lamp bulb which has an essentially tubular extension (6) to a base lamp holding structure (2), the holding structure is formed with a cylindrical recess into which the tubular extension is fitted. The material of the lamp holding structure, or at least a portion adjacent the recess, is a high-temperature meltable plastic, and the extension portion is surrounded by a spiral spring or wire loops which, to attach the lamp to the base lamp holding structure, is subjected to a high-frequency electromagnetic field so that, by induction, the plastic surrounding the extension will melt, and embed the spiral or looped wires in the molten plastic while oozing towards the extension portion to securely grip the extension portion in the base lamp holding structure.

20 Claims, 2 Drawing Sheets

VIBRATION RESISTANT LAMP AND BASE, AND METHOD OF ITS MANUFACTURE

Reference to related patent, the disclosure of which is hereby incorporated by reference, assigned to the assignee of the present application: U.S. Pat. No. 4,795,939, Eckhardt et al.

Reference to related publication: (formerly) East German Patent DD-PS 245 080, Amlong et al.

FIELD OF THE INVENTION

The present invention relates to an electric lamp, and more particularly to an electric lamp suitable for automotive use, and to a method of making such a lamp which permits ready adjustment of the lamp with respect to the focal point of a reflector.

BACKGROUND

The referenced U.S. Pat. No. 4,795,939, Eckhardt et. al., assigned to the assignee of the present application and the disclosure of which is hereby incorporated by reference, describes the connection of a base holding structure with a base sleeve which, together, form a lamp base, and which permits aligning the light emitting element, secured to the base structure in a way so that the base structure will have a predetermined position with respect to the sleeve; the sleeve itself has locating devices to then locate the lamp filament, or discharge electrodes in dependence on the type of lamp, with respect to a reflector, for example an automotive headlight reflector. The (formerly) East German Patent 245 080, Amlong et al, describes a single-base discharge lamp for automotive use, in which a double-ended light source made of hard or quartz glass with pinch-sealed ends is formed with a tubular extension at one end, secured in a lamp base structure. An electrical connection is led to the current supply lead at the double-ended light source remote from the base extending, at least in part, parallel to the discharge vessel and then into the base structure. The discharge vessel is centered in the base structure by the tubular projection, and secured to current supply leads which are connected centrally and to the lead extending from the remote end of the lamp.

This lamp has a disadvantage in that the discharge vessel together with the current supply leads, at the same time forms the mechanical attachment of the light source to the base; thus, the current supply leads are subjected to high mechanical loading; vibration and shock. Mechanical stresses placed on the current supply leads may lead to mechanical failure thereof, causing failure of the lamp well in advance of the failure of the light emitting portion thereof.

THE INVENTION

It is an object to provide a based electric lamp which can be easily made, and provide for readily manufactured seating of the lamp bulb in the holding portion of the base, while permitting easy adjustment of the relative position of the lamp bulb in the holding portion of the base so that the lamp is suitable for use in a reflector, and to provide a method of attachment which can be easily carried out by automatic machinery.

Briefly, the holding structure is formed with a recess to receive a tubular extension projecting from a vitreous bulb, which tubular extension is surrounded with high-frequency responsive means, such as a spiral of coiled metal wire, or a plurality of metal disks. The holding structure itself, at least in the vicinity of the recess, is formed of a plastic material having a melting point which is above, and preferably well above the temperature of the extension portion when the lamp is in operation.

To make the lamp, the extension portion is surrounded by the high-frequency responsive spiral or wire loops, placed in a recess of the holding portion and then subjected to a high-frequency field which causes the plastic material to melt, penetrate between the windings of the spiral or of the loops and securely seat the extension portion in the base structure. Mechanical stresses on the electrode leads, to hold the lamp in place, are eliminated. After manufacture of the lamp, the high-frequency wires or loops can remain in place, totally embedded in the melted plastic material. Of course, before applying the high-frequency field, the position of the light source with respect to the base can be readily adjusted by, for example, optical sensing of the light emitted from the lamp in a test stand, as well known.

The arrangement of the present invention has numerous advantages. The position of the light emitting element of the lamp, that is the electrodes within the bulb, as well as well as the tubular extension thereof in the base holding structure, can readily be adjusted before melting of the holding structure by adjusting the position in axial direction. The plastic, meltable material then, immediately, permits melting of the portion, at least, of the holding structure in the immediate vicinity of the tubular extension of the lamp bulb so that, after the melted plastic material has solidified, the lamp bulb is securely fixed in position. The tubular extension, within the recess of the base structure, forms an interengaging projection-and-recess fit which has excellent adhesive connection and holding.

The attachment is entirely suitable for fully mechanized, inexpensive production. Lamps of this construction have a stable connection with the base, which is highly resistant to vibration and shock. No metallic holding elements are used for mechanical connection of the lamp bulb which, typically, is of hard glass or quartz glass, i.e. a vitreous material, including the light emitting electrodes thereof in the base. This substantially contributes to the resistance of the lamp base with respect to high-voltage pulses. Such high-voltage pulses are necessary if the lamp is a discharge lamp, to permit re-ignition thereof when the lamp is still hot, for example from a prior ignition.

DRAWINGS

DETAILED DESCRIPTION

Figure 1:
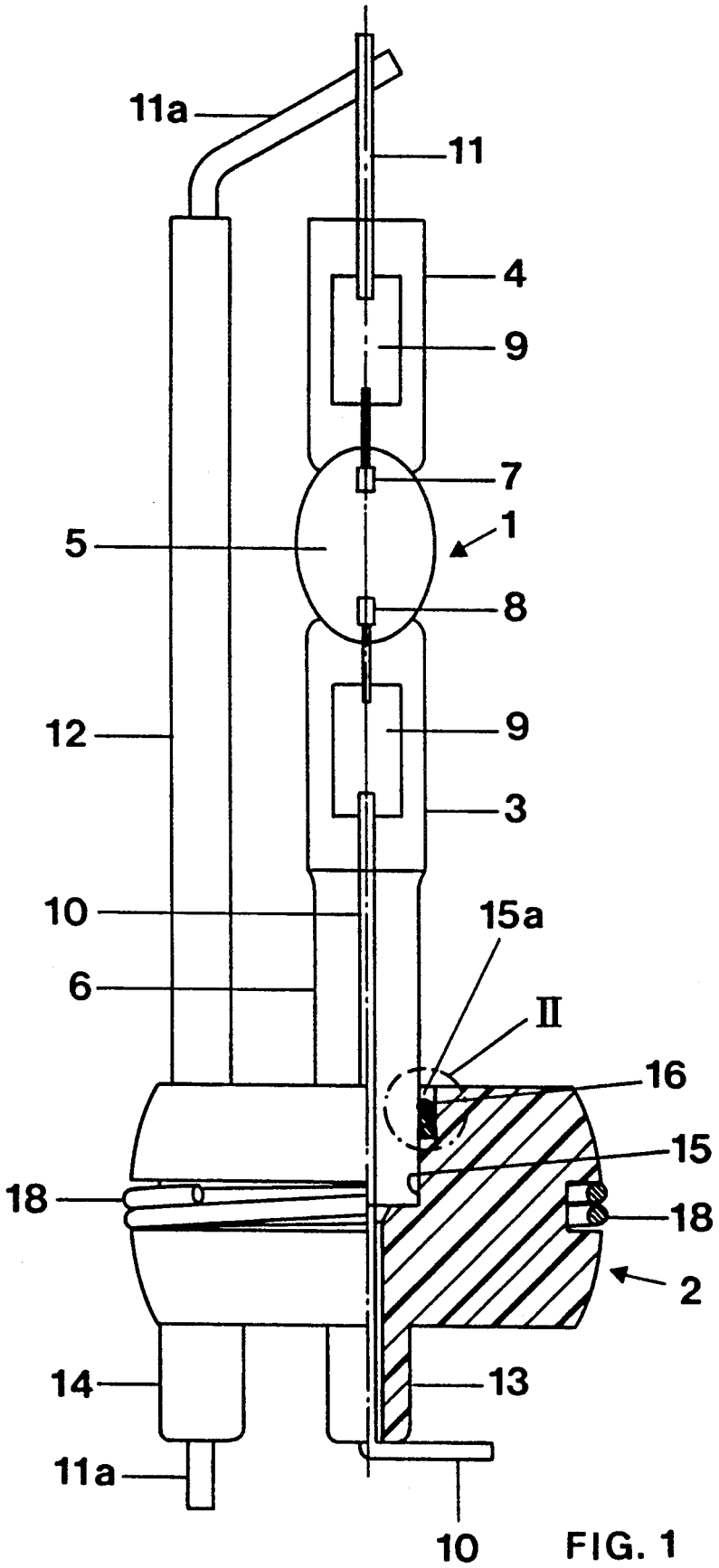
FIG. 1 is a highly schematic side view of the lamp, with the base structure partly in section.
Figure 2:
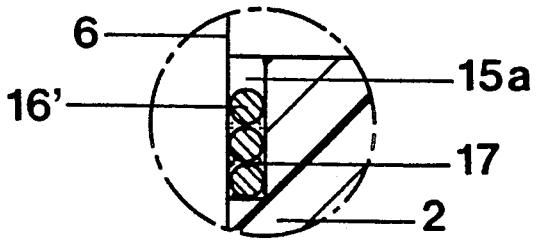
FIG. 2 is a an enlarged view of the portion within the chain-dotted circle II of FIG. 1, and also illustrating another embodiment.

The lamp of FIGS. 1 and 2 is a 35 W metal halide discharge lamp having a discharge vessel 1 of quartz glass. In the specification and claims the discharge vessel 1 will be referred to as having a base end at 3 and a remote end at 4, the respective ends 3, 4 being closed off by pinch seals 3 and 4, respectively. Such lamps can be used, for example, in vehicular head lamps. The lamp, additionally, is formed with a holder structure or base holder structure 2, which retains the discharge vessel 1 in position. The outside of the base holder structure has a steel ring or a plurality of rings 18 located therein, for connection to a base sleeve, not shown, for example by welding. The connection of the assembly of the lamp 1 with the base structure 2 to a base sleeve is described, in detail, in the referenced U.S. Pat. No. 4,795,939, Eckhardt et al.

The discharge vessel 1 has a fill of mercury, a noble gas, or a mixture of noble gases, and metal halide additives. Two opposed electrodes 7, 8 are located within the discharge vessel 5, connected through respective molybdenum foils 9 to current supply leads 10, 11, 11*a* for supply of electrical energy to the lamp. The portion of current supply lead 11*a*, which extends parallel to the discharge vessel 1, is with a ceramic sleeve 12 to prevent photo ionization due to ultraviolet (UV) radiation, and further to prevent electrical arc-over between the current supply leads 10 and 11.

The discharge vessel 1 is formed with a tubular extension 6, which extends into a reception recess 15 formed in the base structure 2, for example as an axial blind bore. The bottom of the recess 15 forms a positioning abutment; other positioning abutments, such as projections from the bottom or the like, may also be used. The diameter of the tubular projection 6, which will be the same as the inner diameter of the recess 15 is, for example, about 5 mm.

In accordance with a feature of the invention, the recess 15 is circumferentially, diametrically expanded, as seen at 15*a* (FIG. 2), at the end portion of the holding part 2, facing the bulb 5. A metallic element, responsive to high-frequency radiation, is located in this expanded portion 15*a*. The high-frequency responsive element can, for example, be a spiral spring 16 having, preferably, two to five winding loops and, for example, and as shown, three windings. Alternatively, rather than using a continuous spiral winding coil, coil, individual wire loops 16' (FIG. 2) or loop segments can be placed above each other in the radially expanded portion 15*a*. The diameter of the expanded portion 15*a* is, for example, about 6 mm, and matched to the outer diameter of the spiral wire spring 16 or the wire loop 16', respectively.

In accordance with a feature of the invention, the holder portion 2 is made, at least in the region in the vicinity of the opening 15 and/or the recess 15*a*, of a high-temperature thermoplastic material, for example polyether ketone, or polyphenylene sulfide. These materials have melting temperatures between about 300' C. and 500° C. The base body 2 is formed with openings for the current supply leads 10 and 11*a*, which terminate shafts 13, 14 formed as part of the base structure 2. The base current supply lead 10, immediately beyond the shaft 13, is bent-over at a right angle away from the shaft 14 of the current supply lead 11*a*, so that the spacing between the two current supply leads 10 and 11*a* is increased. The shaft portion 13 may be extended so as to cover the region of the bend of current supply lead 10 facing the lead 11*a*.

METHOD OF MANUFACTURE OF THE LAMP

The bulb 1 of the lamp, which may be a discharge vessel, together with the tubular extension portion 6, is made in accordance with any suitable and well known manufacturing process. The base structure 2 is formed with the axial bore 15, and the expanded bore portion 15*a*. The diameters of the bores 15, 15*a* are selected so that the extension 6 will fit within the bore 15, and the spiral spring 16 and/or the loops 16' fit around the extension 6 and within the enlarged portion 15*a*. The depth of the reception opening 15 extends to approximately half the height of the base structure 2 which, preferably, is slightly outwardly bowed, that is, is barrel-shaped.

A metallic, high-frequency responsive element 16, in form of a spiral spring, or a plurality of loops 16', are then pushed over the tubular extension 6 of the discharge vessel, for example up to about one-third from the end of the extension 6. The tubular extension 6, together with the metallic loops or springs 16', 16, is then inserted to a selected depth in the recess 15, preferably to the bottom thereof, or to a stop, and, in this insertion step, the spring 16 or loop 16' will fit into the recess 15*a*.

A conductive loop is placed about the tubular extension 6 in immediate vicinity of the metallic element 16, 16', forming the primary winding of an electric current circuit, connected to a high-frequency generator. The axial position of the lamp with respect to a reference, for example as determined optically, can be adjusted by placing the lamp in a suitable jig, energizing the lamp terminals, and measuring the light intensity with respect to a predetermined reflector or other optical system. By pulling the lamp slightly out of the base 2, the focal position of the light emitting portion of the lamp can thus be adjusted with respect to the position of the base.

A high-frequency pulse from the high-frequency generator is then passed through the conductive loop which induces a high current pulse in the windings of the spring 16 and/or the individual loops 16', causing the thermoplastic material of the holder parts 2 in the immediate vicinity of the metallic secondary to melt and to ooze between the windings of the spring 16, or, respectively, between the loops of the individual windings 16' towards the quartz glass wall of the tubular extension 6.

Upon solidifying of the melt, the discharge vessel 1 and the base holder structure 2 will thus be securely connected together in a projection-recess fit, adhesively coupled at the boundary surfaces of the quartz glass of the extension 6 with the thermoplastic material of the holder portion 2.

The heating temperature of the thermoplastic material is determined by the duration of the high-frequency pulse and, for example, may be in the order of about 800° C. This is substantially below the melting or softening temperature of the quartz glass of the tubular extension 6. Under ordinary conditions, and for a discharge lamp, the operating temperature of the tubular extension 6 is in the order of about 160° C., which is substantially below the melting temperature of the thermoplastic material of the holder portion 2, so that the adhesive and melt connnection between the discharge vessel 1 and the holder or base portion 2 will retain its integrity during the entire operation of the lamp.

The invention has been described in connection with a discharge lamp; it is not limited, however, to a metal halide discharge lamp, but may be used with lamps of other constructions as well. Thus, the electrodes 7, 8 can be connected to filaments, and the bulb 1 can retain a fill suitable for incandescent lamps, which may include a halogen; the bulb can be made of quartz glass or hard glass, and the bulb can, also, be made as a single-ended bulb, having only a single pinch seal through which two current leads extend, the pinch seal being formed or left with a tubular extension for connection to the base structure 2.

The high-frequency responsive structure 16, 16' is, preferably, made of a ferromagnetic material, such as an iron-nickel alloy. After melting, the connection between the extension tube 6, the spring or loops 16, 16', and the material of the base structure 2, will form an interlocked, molten mass providing for secure mechanical connection, in which all mechanical stresses on the electrical connecting leads are relieved.

Figure 3:
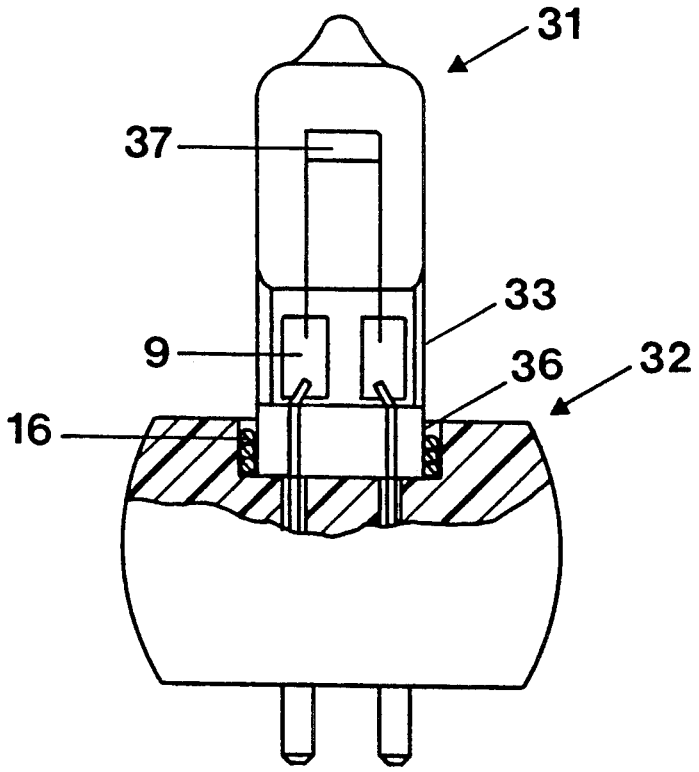
FIG. 3 is a highly schematic view of a halogen incandescent lamp fitted into a base in accordance with the present invention.

FIG. 3 illustrates that the present invention is equally applicable to single-ended lamps, for example lamps having filaments. FIGS. 3, specifically, shows a halogen incandescent lamp 31, having a filament 37, connected to a base 32. The pinch seal 33 retains two molybdenum foil connections. The tubular extension 36, similar to the tubular extension 6 of FIG. 1, extends into the bore formed in the base lamp holding structure 32.

Various changes and modifications may be made within the scope of the inventive concept; the base connection is not limited to the particular embodiment described but may be used with lamps of other constructions as well, although particularly applicable to small lamps for use, for example, in combination with optical elements, such as reflectors, and suitable in automotive application.

The attachment arrangement of the bulb to the base is particularly suitable in single-based lamps although it could also be used in double-based lamps.

What is claimed is:

1. A lamp having a base-lamp holding structure (2) of electrically insulating material;

a lamp bulb (1) of vitreous material, having a base end, and an extension portion (6) formed on the base end, said holding structure (2) being formed with a recess (15) receiving said extension portion (6) of the lamp bulb;

electrodes (7, 8) located in the lamp bulb (1) and first and second current supply leads (10, 11) connected to said electrodes, said current supply leads extending outwardly of the bulb, and wherein the base-lamp holding structure (2) comprises, at least in the vicinity of said recess, a meltable plastic material having a melting point above the temperature of said extension portion (6) at the operating temperature when the lamp is in operation; and high-frequency electromagnetic responsive means (16, 16') located in said base-lamp holding structure (2) and surrounding said extension portion (6), said meltable plastic material engaging said extension portion of the bulb and embedding said high-frequency responsive means.

2. The lamp of claim 1, wherein said extension portion (6) is essentially tubular; and wherein said high-frequency electromagnetic responsive means (16) comprises a spiral spring having a plurality of spiral windings surrounding said tubular extension portion, of optionally two to five windings.

3. The lamp of claim 1, wherein said extension portion (6) is essentially tubular; and wherein said high-frequency responsive means (16') comprises at least one metallic ring or loop, or ring segment surrounding, at least in part, said extension portion.

4. The lamp of claim 1, wherein said high-frequency responsive means (16, 16') comprises at least part-circular elements of ferromagnetic material.

5. The lamp of claim 4, wherein said ferromagnetic material comprises an iron-nickel alloy.

6. The lamp of claim 1, wherein said recess (15) is dimensioned and shaped to, at least in part, essentially snugly receive said extension portion (6);

and wherein said recess is formed with a region of enlarged dimension (15*a*), said high-frequency responsive means (16, 16') being located in said region of enlarged opening dimension.

7. The lamp of claim 6, wherein said extension portion (6) is essentially tubular;

said recess (15) is a cylindrical bore having a diameter corresponding to the outer diameter of said essentially tubular extension portion (6), and said region (15*a*) of enlarged opening dimension is an essentially cylindrical region located adjacent the surface of the base-lamp holding structure (2) facing the bulb and dimensioned to have a diameter larger than the outer diameter of said essentially tubular extension portion (6).

8. The lamp of claim 1, wherein said extension portion (6) is essentially tubular; and said recess (15) is an essentially cylindrical opening for the end of said essentially tubular extension.

9. The lamp of claim 1, wherein said base-lamp holding structure (2) is formed of said meltable plastic material and essentially consists of high-temperature resistant thermoplastic and, optionally, comprising at least one of: polyether ketone; polyphenylene sulfide.

10. The lamp of claim 1, wherein said base-lamp holding structure (2) is formed with axial openings to permit passage of at least one of said first and second current supply leads (10, 11) therethrough.

11. The lamp of claim 10, wherein said lamp is a single-based lamp and said first and second current supply leads pass through the base-lamp holding structure (2);

and wherein the base-lamp holding structure is formed with essentially cylindrical extension portions (13, 14) for shielding and insulating said first and second current supply leads from each other.

12. The lamp of claim 10, wherein said lamp is a single-based lamp;

and one (10) of said current supply leads is bent away from the other current supply lead immediately beyond the exit of the first current supply lead from the respective opening in the base lamp holding structure (2).

13. The lamp of claim 1, wherein said lamp is a single-based lamp;

the lamp bulb comprises a high-pressure discharge lamp and formed with oppositely positioned pinch or press seals (3, 4), the first and second current supply leads being conducted out of the respective pinch or press seals.

14. The lamp of claim 1, wherein said lamp is a single-based lamp, and said lamp bulb (1) comprises a single-ended high-pressure discharge lamp having a single pinch or press seal, from which said first and second current supply leads extend.

15. The lamp of claim 1, wherein said lamp is a single-ended halogen incandescent lamp, and said first and second current supply leads (10, 11) extend from a single pinch or press seal of said lamp.

16. The lamp of claim 1, wherein said lamp is a discharge lamp, and said lamp bulb (1) as well as said extension portion (6) comprise quartz glass.

17. A method of making a based lamp, as claimed in claim 1, including the steps of connecting said base-holding structure (2) to said extension portion (6) by heating said high-frequency responsive means (16, 16') by applying a high-frequency electromagnetic field to said high-frequency responsive means to thereby melt said meltable plastic material and flow against and engage over said extension portion (6) and embed said high-frequency responsive means therein.

18. The method of claim 17, further including the following steps:

pre-forming said high-frequency responsive means (16, 16') in ring or loop form;

forming said extension portion (6) to be essentially tubular;

pushing the ring or loop formed high-frequency responsive means over the essentially tubular extension portion;

forming said recess in the base-lamp holding structure as a blind bore (15) having an outer end portion (15*a*) of increased diameter;

introducing said tubular extension portion, with the ring or loop formed high-frequency responsive means thereon into said tubular bore (15) and fitting said ring or loop formed high-frequency responsive means into the portion of increased diameter;

axially adjusting the position of the lamp bulb with respect to the base-lamp holding structure (2);

inductively coupling the high-frequency responsive means to a high-frequency energy source; and applying a high-frequency pulse from said source, to thereby heat said high-frequency responsive means to a temperature which melts the meltable plastic material.

19. The method of claim 18, wherein said high-frequency responsive means comprises at least one of: a spiral spring of steel; a plurality of rings or loops of metallic material.

20. The method of claim 17, wherein said lamp comprises a single-based lamp, and said base-lamp holding structure (2) is formed with openings positioned and dimensioned to receive said first and second current supply leads (10, 11).

* * * * *